US008226324B2

(12) United States Patent
Chapple

(10) Patent No.: US 8,226,324 B2
(45) Date of Patent: Jul. 24, 2012

(54) UNFOLDING RIDE-ON POWER TROWEL

(75) Inventor: Larry Jake Chapple, Boise, ID (US)

(73) Assignee: Multiquip, Inc., Carson, CA (US)

( * ) Notice: Subject to any disclaimer, the term of this patent is extended or adjusted under 35 U.S.C. 154(b) by 214 days.

(21) Appl. No.: 12/698,975

(22) Filed: Feb. 2, 2010

(65) Prior Publication Data

US 2010/0202833 A1 Aug. 12, 2010

Related U.S. Application Data

(60) Provisional application No. 61/149,322, filed on Feb. 2, 2009.

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS 5,934,823 A * 8/1999 Allen ..... 404/112
5,988,938 A 11/1999 Allen
6,250,844 B1 * 6/2001 Sartler et al. ..... 404/112
D602,961 S * 10/2009 Chapple et al. ..... D15/10

* cited by examiner

*Primary Examiner* — Gary S Hartmann
(74) *Attorney, Agent, or Firm* — Frank J. Dykas; Scott D. Swanson; Dykas & Shaver, LLP

(57) ABSTRACT

Disclosed is an unfolding ride-on machine having a frame, a front cover and back cover supported by the frame, and internal workings supported by the frame and contained within an internal space. A right side cover and left side cover are pivotally connected to the frame. A seat platform is pivotally connected to the front or back covers. Each of the right side cover, left side cover, and seat platform are configured to pivotally transition between a closed configuration and an open configuration. In the open configuration, the internal workings are readily accessible.

13 Claims, 17 Drawing Sheets

UNFOLDING RIDE-ON POWER TROWEL

PRIORITY/CROSS-REFERENCE TO RELATED APPLICATIONS

This application claims the priority date of the provisional application entitled "Unfolding Ride-On Power Trowel" invented by Larry Jake Chapple and filed on Feb. 2, 2009, with application Ser. No. 61/149,322, the disclosure of which is incorporated herein by reference.

FIELD OF THE INVENTION

The invention generally relates to a ride-on machine having internal workings, and more particularly to a ride-on power trowel having internal workings.

BACKGROUND OF THE INVENTION

Power trowels involve a great number of moving parts. Parts such as belts, conduits, engines, batteries, and the like are often supported by the frame of the trowel, but with such parts located in an internal area of the trowel. Positioning such parts in an internal area of the trowel reduces the risk that an operator will come into unintended contact with these moving, hot, or otherwise dangerous parts. It further allows the external parts of the trowel to shield the unsightly internal parts from observers. However, locating these internal workings inside the trowel makes it more difficult to provide needed maintenance to the trowel. Often significant sections of the exterior of the trowel must be physically disconnected from the rest of the trowel so as to allow a mechanic access to the internal workings. Such disassembly often requires a significant amount of time, skill, tooling, and effort to accomplish. Further, requiring workers to move heavy parts of a trowel presents opportunities for accidents. Also, every part that must be disconnected from the trowel to allow for routine maintenance presents a risk for a lost part that will need to be replaced. Still further, repeated manipulation of hardware, such as nuts, screws, and the like, can lead to stripping or other wear of the hardware, leading to increased need to replace such hardware.

SUMMARY OF THE INVENTION

The present unfolding ride-on power trowel allows ready access to the internal workings of a power trowel without substantial disassembly of the trowel. The unfolding ride-on power trowel includes a frame that supports a front cover and a back cover. The internal workings of the trowel, such as the engine, are also supported by the frame of the trowel. A right side cover is pivotally connected to the frame and can be pivoted between a right open configuration and a right closed configuration. A left side cover is also pivotally connected to the frame and can be pivoted between a left open configuration and a left closed configuration. Additionally, as the unfolding ride-on power trowel is to be operated by an operator, the trowel further includes a seat supported by a seat platform. In some embodiments, the seat platform is pivotally connected to the front cover. In other embodiments, the seat platform is pivotally connected to the back cover. In either regard, the seat platform can be pivoted between a seat open configuration and a seat closed configuration. When the right side cover is in the right closed configuration, the left side cover is in the left closed configuration, and the seat platform is in the seat closed configuration, the internal workings of the unfolding ride-on power trowel are not readily accessible.

Accessibility is made possible by pivoting any of the right side cover, the left side cover, the seat platform, or any combination thereof to its respective open position. In some embodiments, the accessibility of the internal workings is made possible without any disassembly of the unfolding-power trowel.

In other embodiments, side gratings are removably connected with the right side cover and the left side cover. In these embodiments, preferably, the respective side grating is removed before the right side cover is transitioned to the right open configuration or the left side cover is transitioned to the left open configuration. Preferably, the removal of a side grating is accomplished by disconnecting only one connection of hardware. Thus, even in this embodiment, no substantial disassembly of the unfolding ride-on power trowel is necessary to gain ready access to the internal workings of the trowel.

The purpose of the Summary is to enable the public, and especially the scientists, engineers, and practitioners in the art who are not familiar with patent or legal terms or phraseology to determine quickly, from a cursory inspection, the nature and essence of the technical disclosure of the application. The Summary is neither intended to define the invention of the application, which is measured by the claims, nor is it intended to be limiting as to the scope of the invention in any way.

Still other features and advantages of the claimed trowel will become readily apparent to those skilled in the art from the following detailed description describing preferred embodiments of the trowel, simply by way of illustration of the best mode contemplated by carrying out the trowel. As will be realized, the trowel is capable of modification in various obvious respects all without departing from the invention. Accordingly, the drawings and description of the preferred embodiments are to be regarded as illustrative, and not restrictive.

DESCRIPTION OF THE PREFERRED EMBODIMENTS

Figure 1:
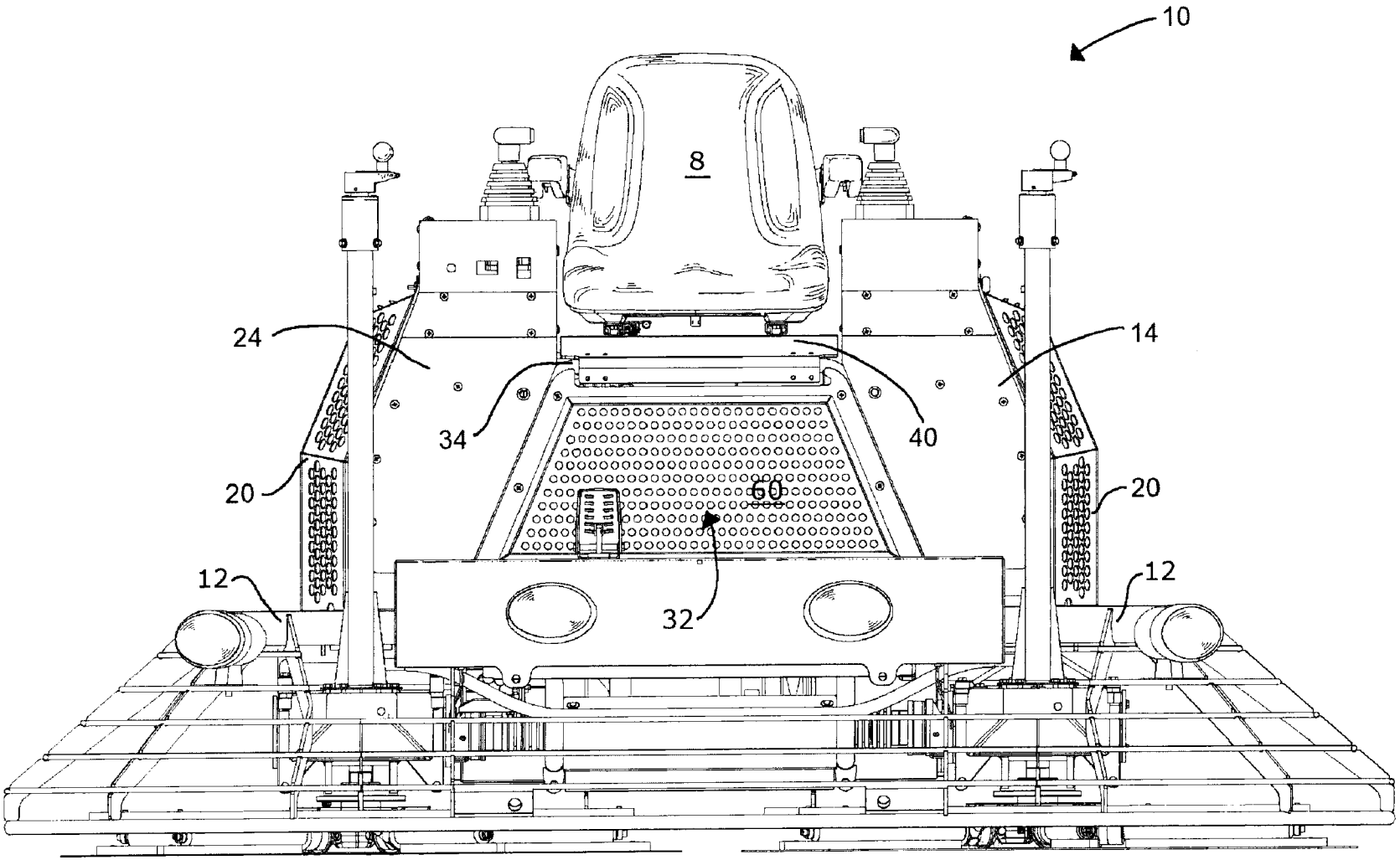
FIG. 1 is a front elevation view of an unfolding ride-on power trowel in a closed configuration according to a first embodiment.

While the unfolding ride-on power trowel is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

As shown in the figures, for purposes of illustration, the unfolding ride-on power trowel comprises a ride-on power trowel, the internal workings of which are made readily accessible simply by selectively pivoting a right side cover to a right open configuration, a left side cover to a left open configuration, and/or a seat platform to a seat open configuration.

Figure 12:
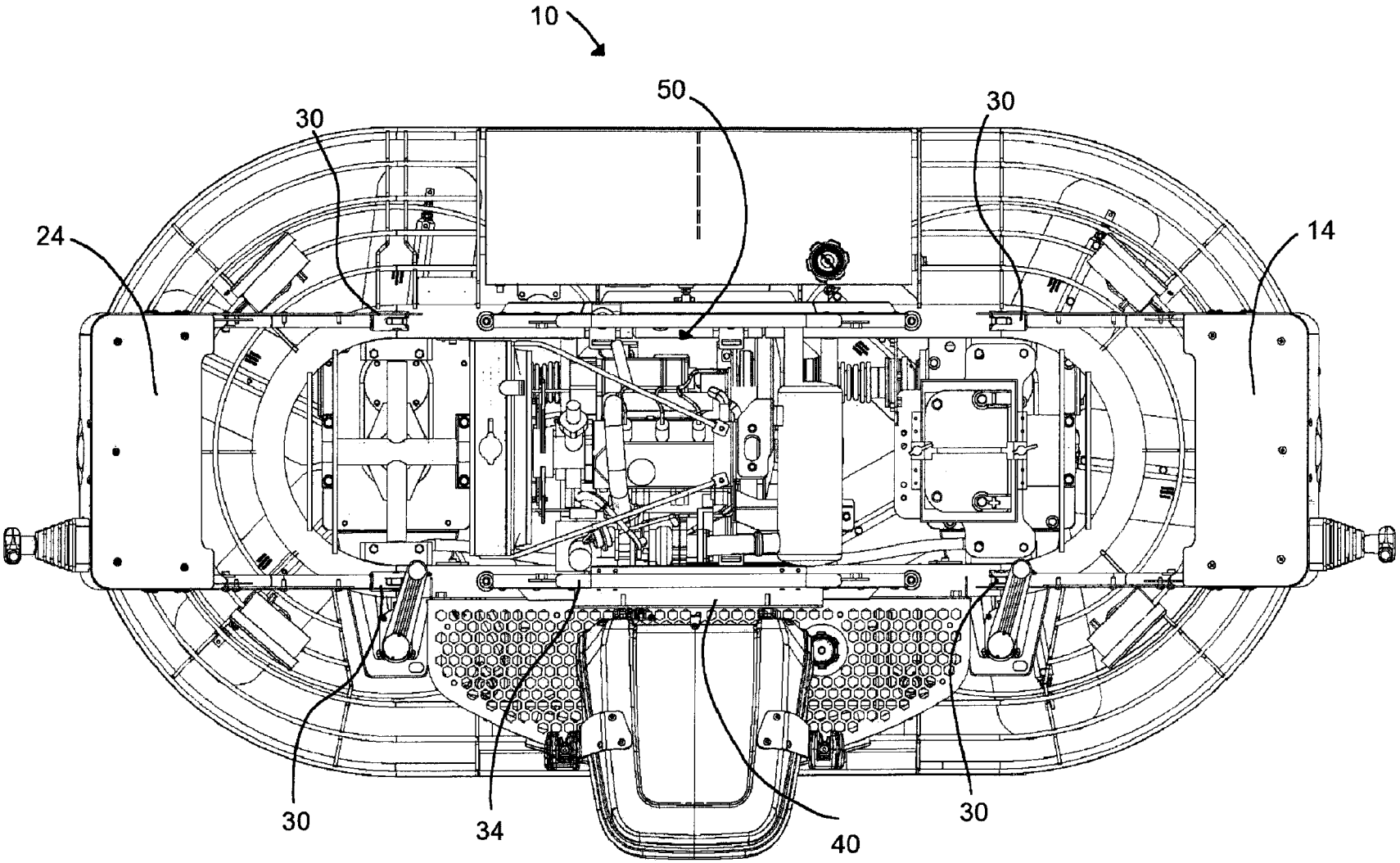
FIG. 12 is a top view of an unfolding ride-on power trowel in an open configuration according to a first embodiment.
Figure 13:
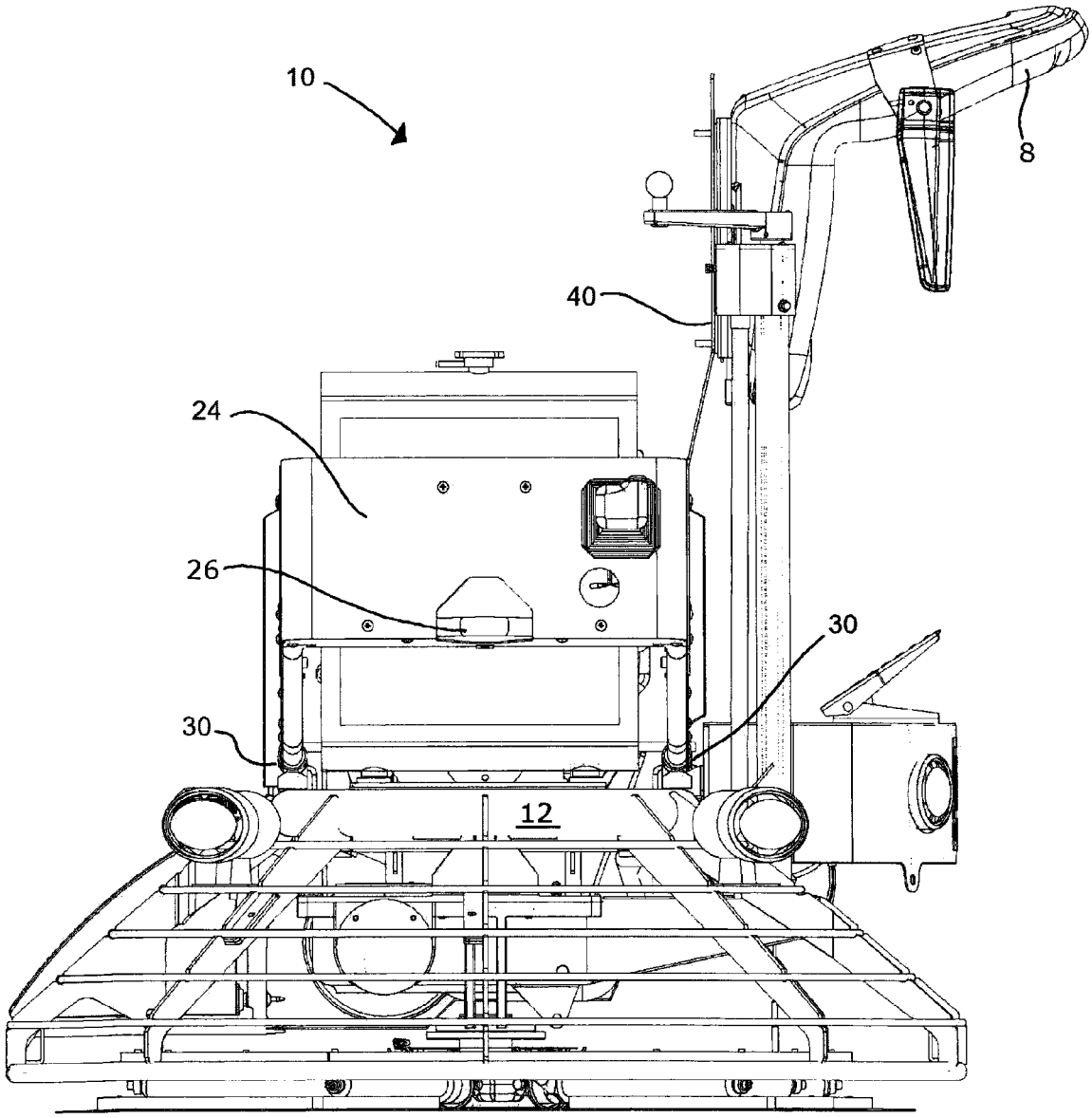
FIG. 13 is a left side elevation view of an unfolding ride-on power trowel in an open configuration according to a first embodiment.
Figure 14:
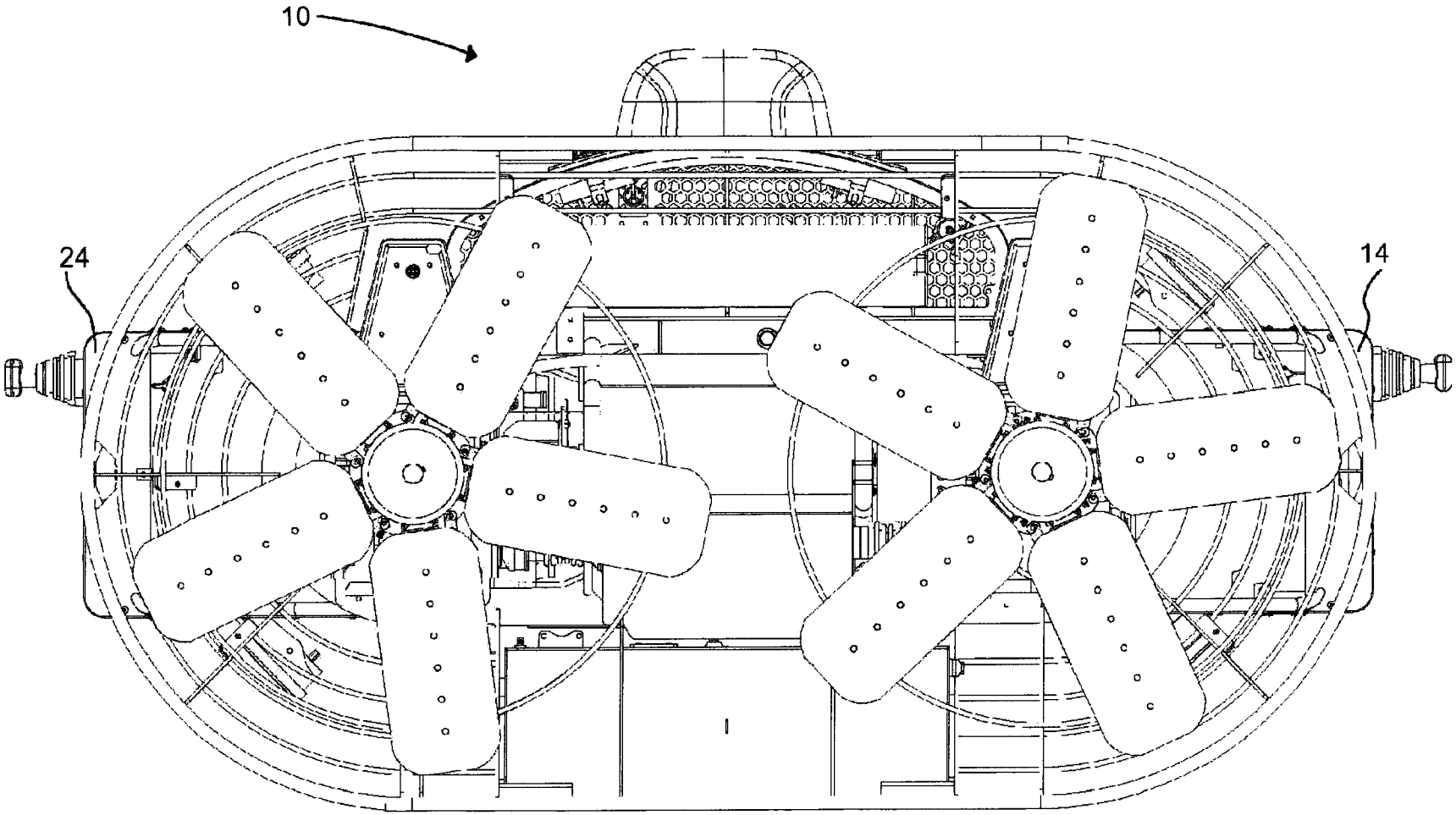
FIG. 14 is a bottom view of an unfolding ride-on power trowel in an open configuration according to a first embodiment.

As shown in FIG. 1, the preferred embodiment of the unfolding ride-on power trowel 10 comprises a trowel having a frame 12, internal workings 50 (shown in FIG. 12), a front cover 32, a back cover 36, a right side cover 14, a left side cover 24, and a seat 8 upon a seat platform 40. The unfolding ride-on power trowel 10 is designed to operate while an operator sits atop the machine in a seat 8 supported by the seat platform 40. The frame 12 supports the rest of the trowel 10.

FIGS. 1 through 7 depict the unfolding ride-on power trowel 10 with the right side cover 14 in the right closed configuration, the left side cover 24 in the left closed configuration, and the seat platform 40 in the seat closed configuration. In this closed configuration, access to the internal workings 50 is substantially blocked. Further, the line of sight to the internal workings 50 is further largely blocked, thus increasing the aesthetics of the appearance of the machine during operation. This configuration further protects those outside of the machine from inadvertently contacting the internal workings 50, and thus decreases the hazard risk to the operator sitting above the internal workings 50 during operation of the ride-on trowel 10.

Also as shown in FIGS. 1 through 7, in the closed configuration, the unfolding ride-on power trowel 10 further includes side gratings 20. Each side grating 20 is configured to attach to one of the right side cover 14 and the left side cover 24.

The unfolding ride-on power trowel 10 is configured so that the right side cover 14 may be selectively moved to a right open configuration, the left side cover 24 may be selectively moved to a left open configuration, and the seat platform 40 may be selectively moved to a seat open configuration. This open configuration is depicted in FIGS. 8 through 15. In this open configuration, access to the internal workings 50 of the unfolding ride-on power trowel 10 is readily available. Thus, simply transitioning the right side cover 14 to the right open configuration, the left side cover 24 to the left open configuration, and the seat platform 40 to the seat open configuration provides quick access to the internal workings 50 of the trowel, such as the engine. This is accomplished without substantial disassembly of the power trowel 10.

Figure 2:
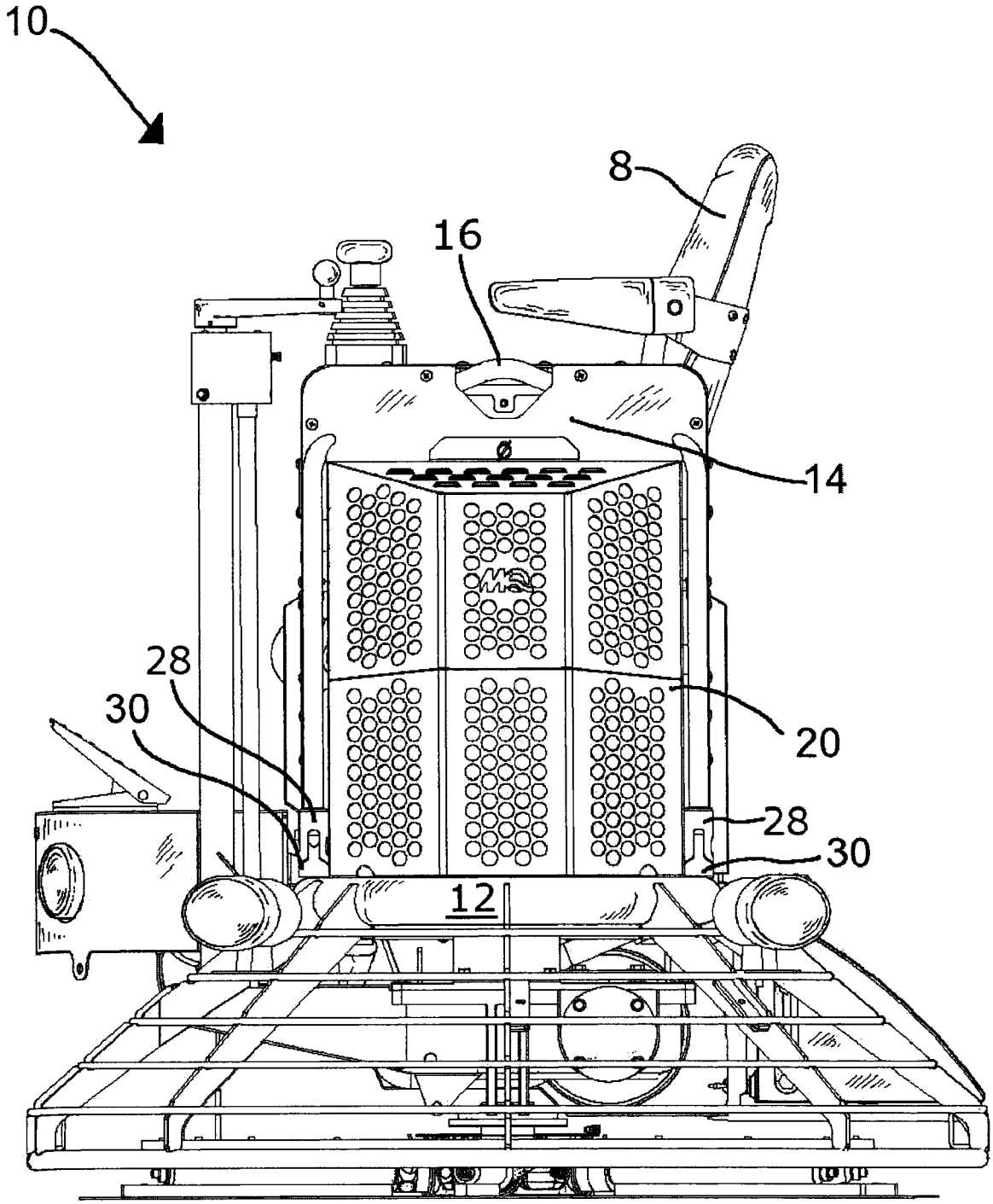
FIG. 2 is a right elevation view of an unfolding ride-on power trowel in a closed configuration according to a first embodiment.
Figure 3:
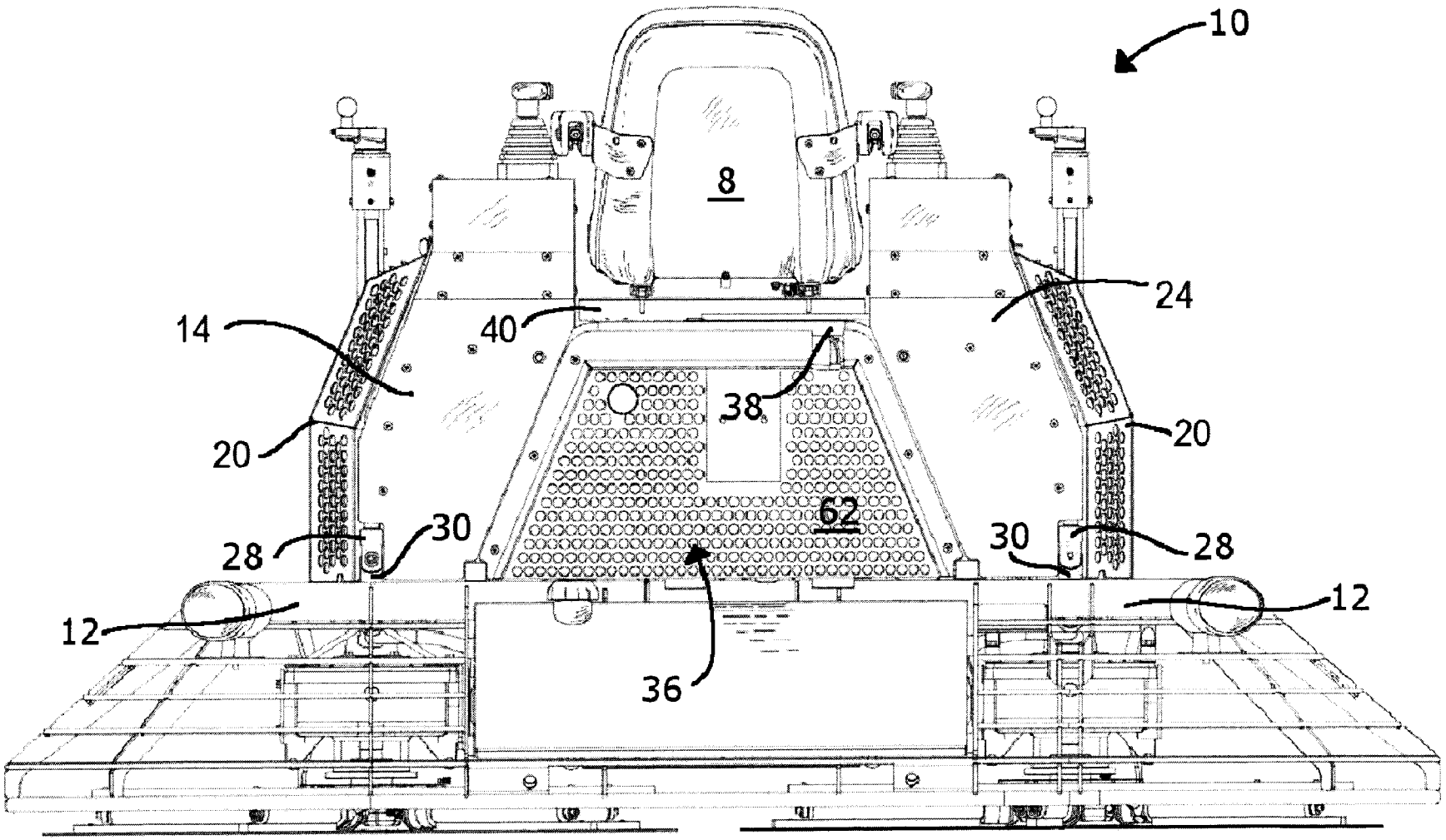
FIG. 3 is a back elevation view of an unfolding ride-on power trowel in a closed configuration according to a first embodiment.
Figure 4:
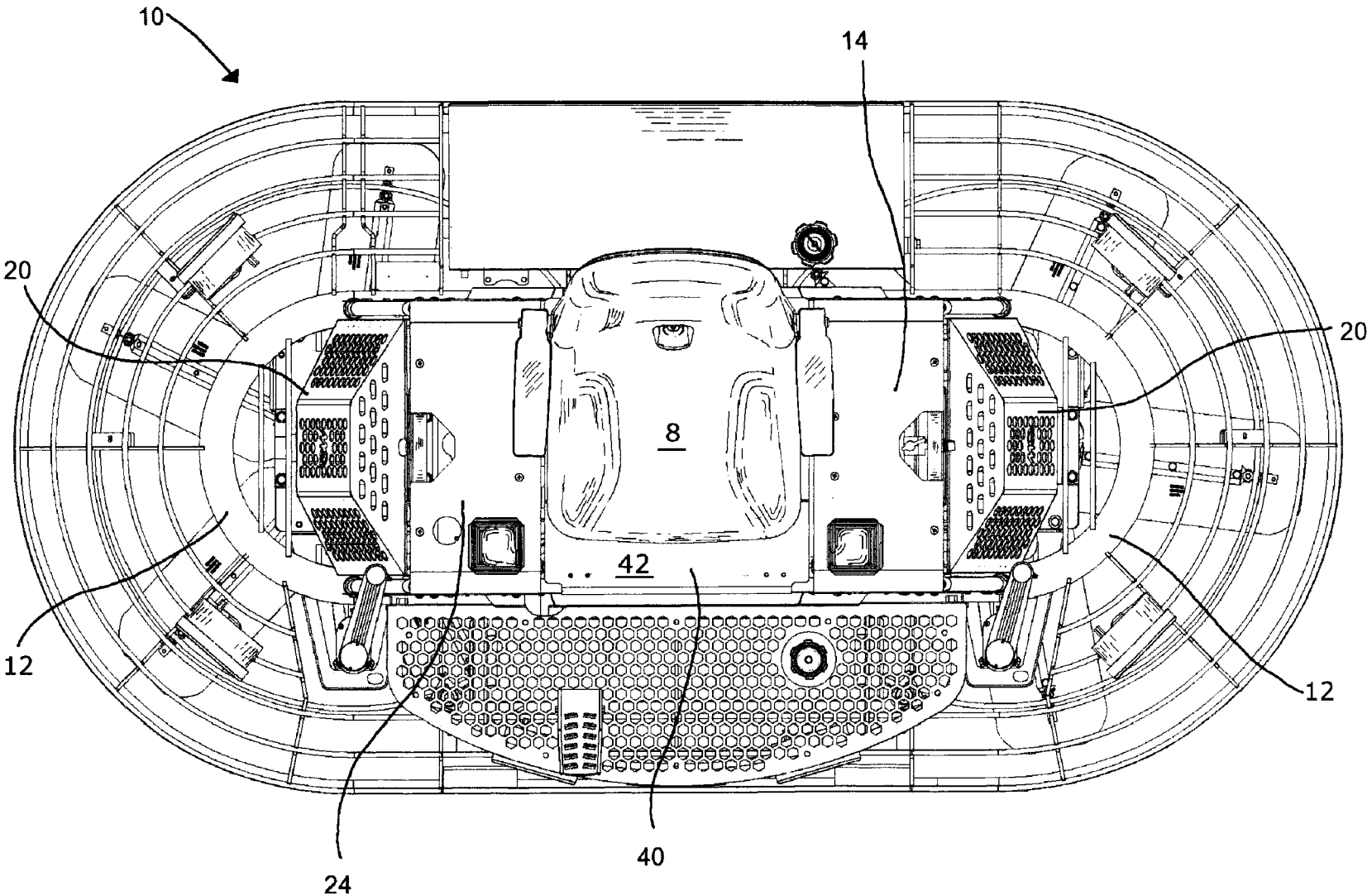
FIG. 4 is a top view of an unfolding ride-on power trowel in a closed configuration according to a first embodiment.

More specifically, the right side cover 14 includes pivot connections 28 (shown in FIG. 17) that are configured for connecting to pivots 30 attached to and supported by the frame 12, specifically a pair of right pivots 30 (FIG. 2). Through this interconnection, the right side cover 14 is pivotally connected to the frame 12 of the ride-on power trowel 10 via the pivots 30 (shown in FIGS. 2 and 10), about which the right side cover 14 may selectively pivot to move between the right closed configuration (FIG. 2) and the right open configuration (FIG. 10), and vice versa. Preferably, the right side cover 14 further includes a right handle 16 configured to be utilized by an operator in transitioning the right side cover 14 between the right closed configuration and the right open configuration and vice versa.

Figure 16:
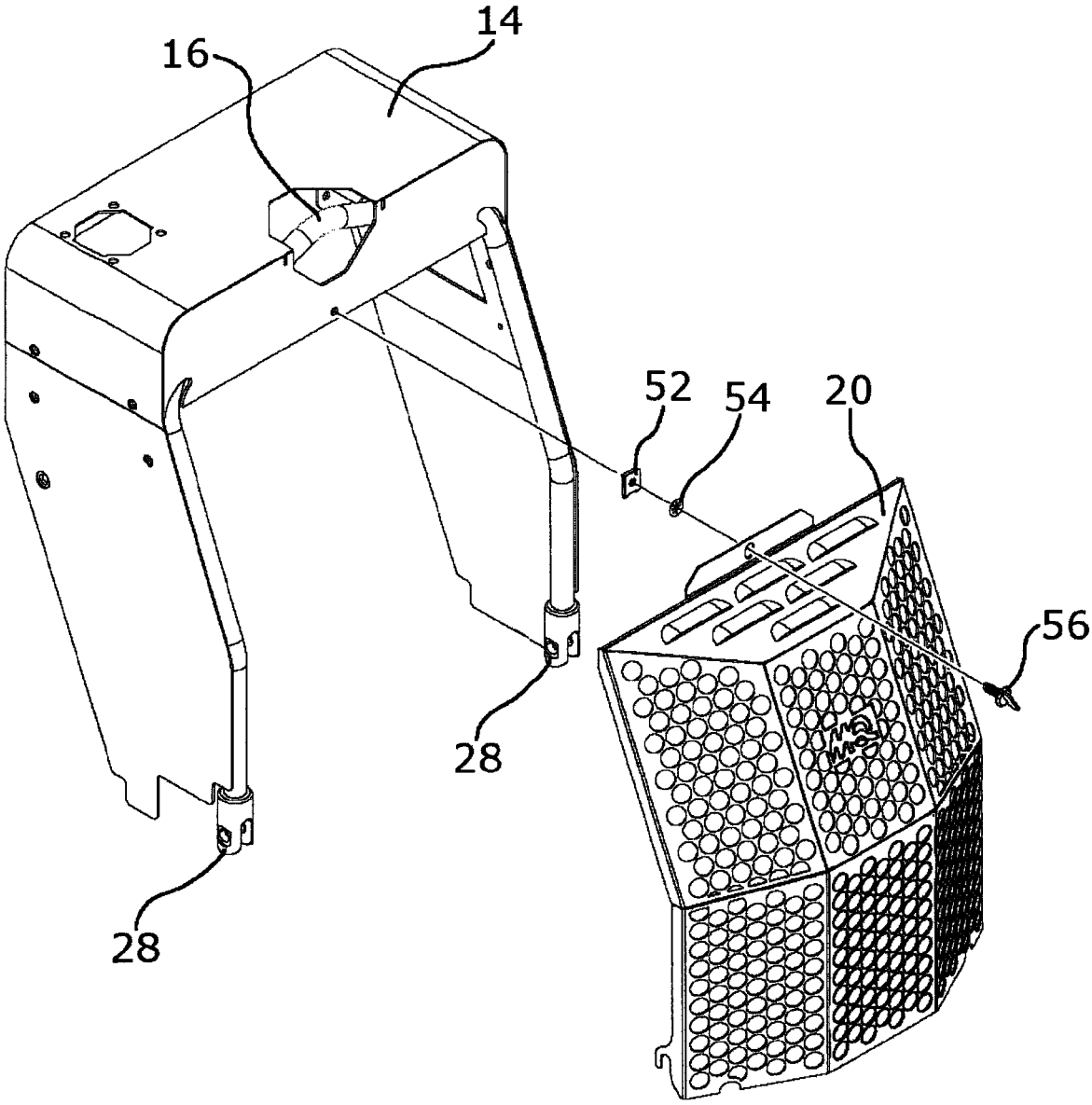
FIG. 16 is an exploded view of a right side cover and side grating of an unfolding ride-on power trowel according to a first embodiment.

According to the preferred embodiment, a right side grating 20 (FIGS. 2 and 16) is configured to be removably attached to the right side cover 14 and is preferably removed prior to the transition of the right side cover 14 from the right closed configuration to the right open configuration. Preferably, the side grating 20 is replaced after the right side cover 14 is transitioned from the right open configuration to the right closed configuration. More particularly, as shown in FIG. 16, the right side grating 20 is configured to be removably attached to the right side cover 14 via hardware such as a clip 52, washer 54, and screw 56. According to the depicted embodiment, therefore, only one connection need be disconnected to accommodate removal of the right side grating 20 from the right side cover 14. Thereafter, the right side cover 14 can be pivotally transitioned to the right open configuration, allowing access to the right-most of the internal workings 50 without having to further disassemble the unfolding ride-on power trowel 10. Preferably, this access to the right-most of the internal workings 50 is further accomplishable without having to transition the left side cover 24 to the left open configuration and without having to transition the seat platform 40 to the seat open configuration.

Figure 5:
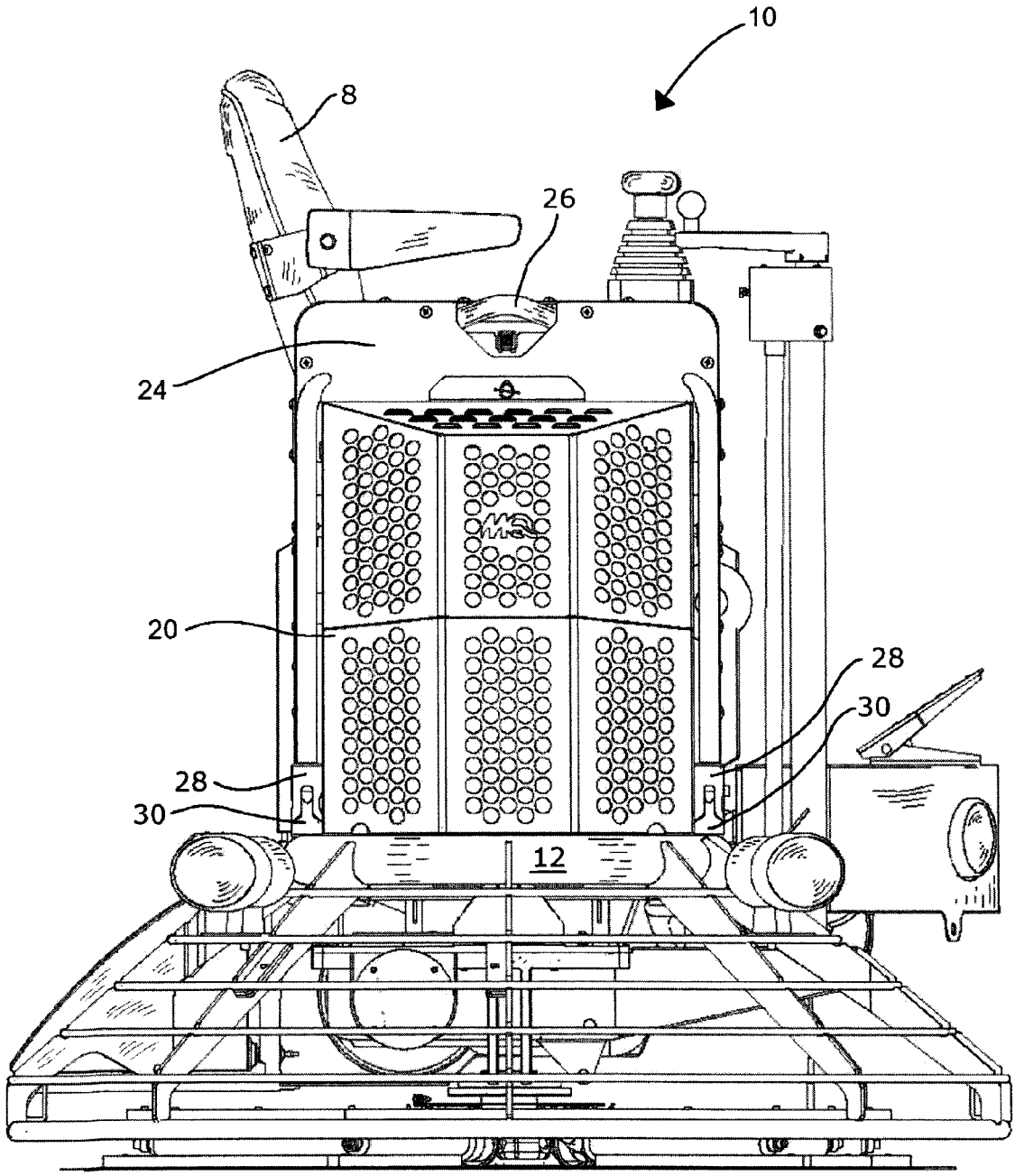
FIG. 5 is a left elevation view of an unfolding ride-on power trowel in a closed configuration according to a first embodiment.
Figure 6:
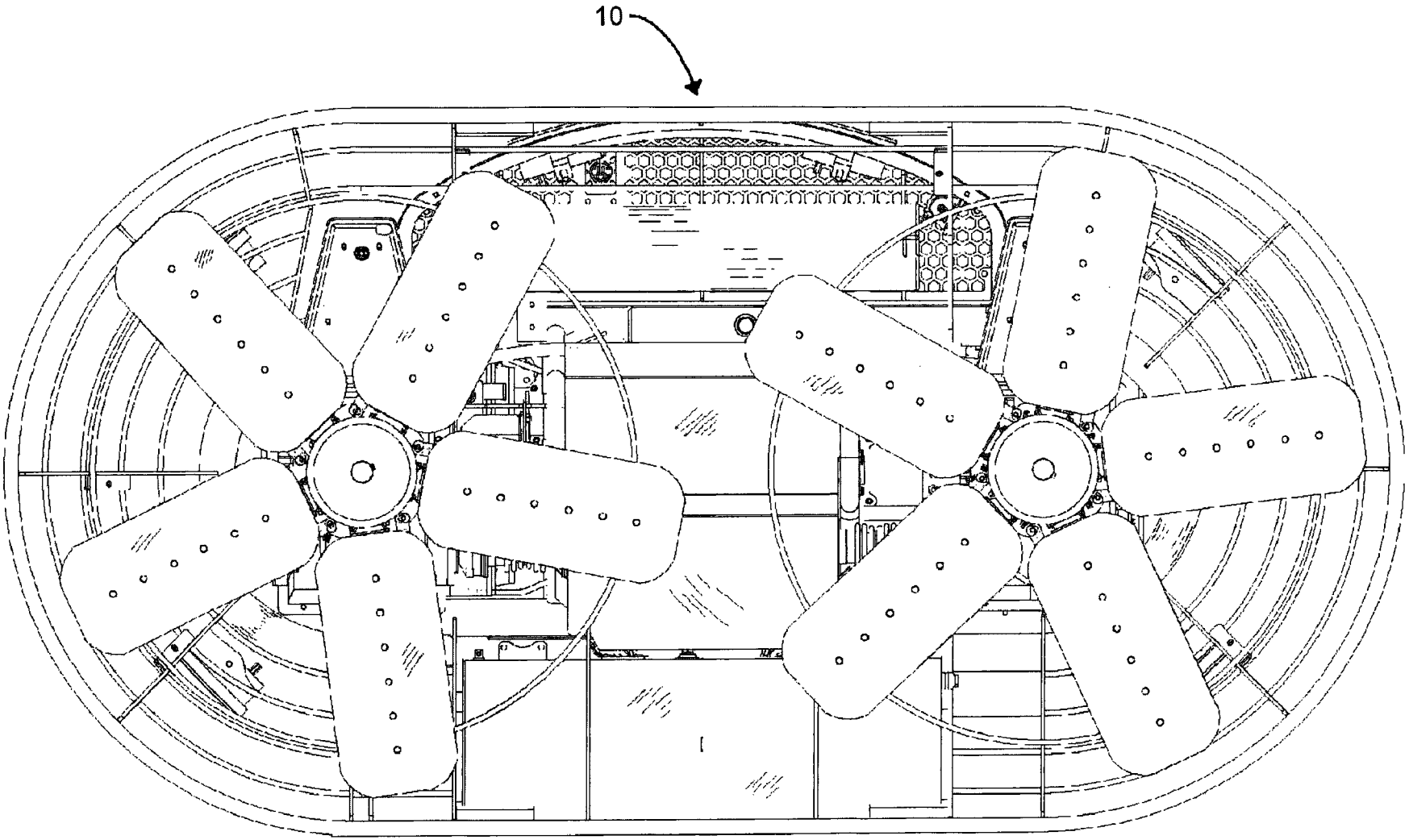
FIG. 6 is a bottom view of an unfolding ride-on power trowel in a closed configuration according to a first embodiment.
Figure 7:
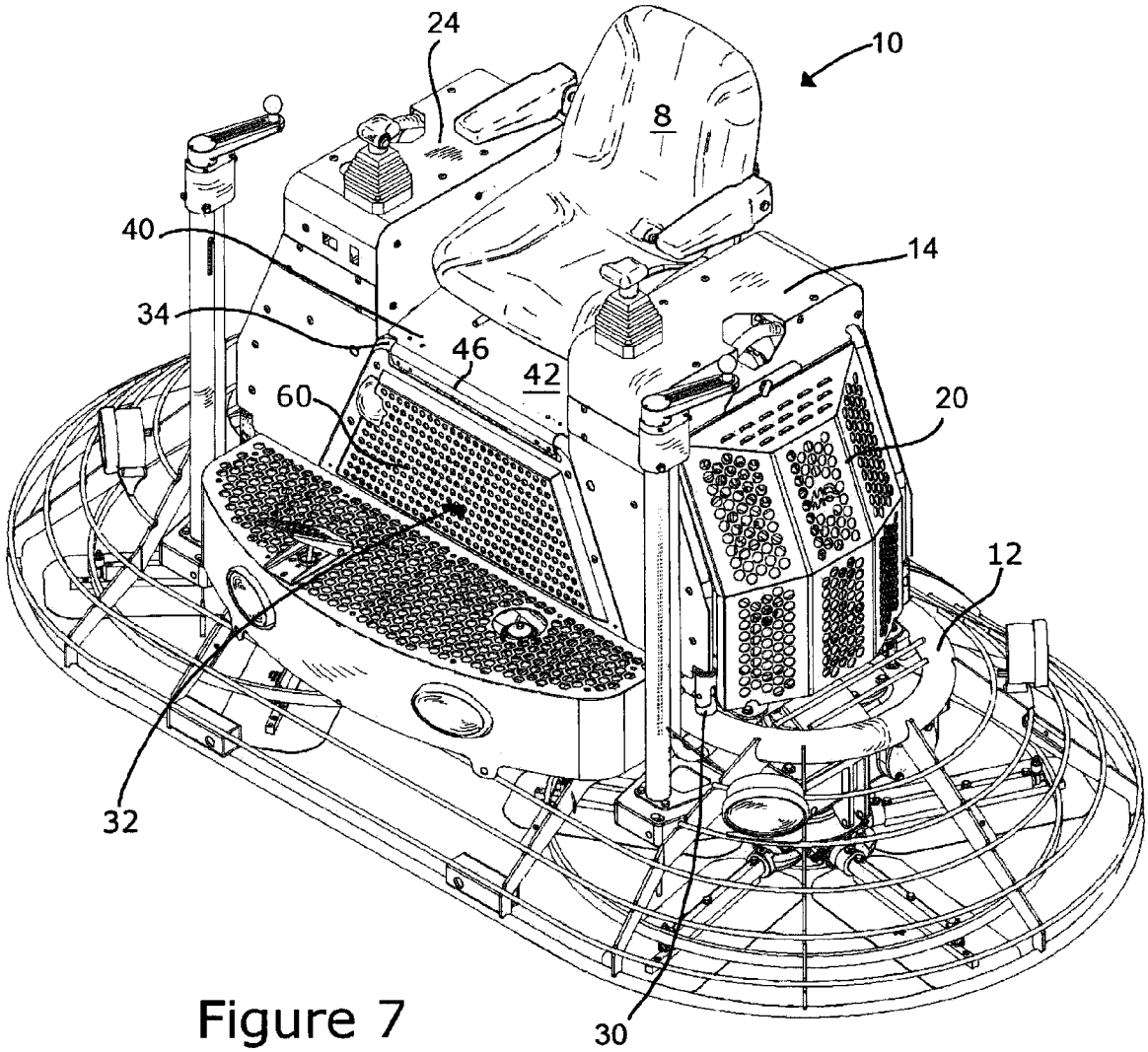
FIG. 7 is an isometric view of the front, top, and right of an unfolding ride-on power trowel in a closed configuration according to a first embodiment.
Figure 8:
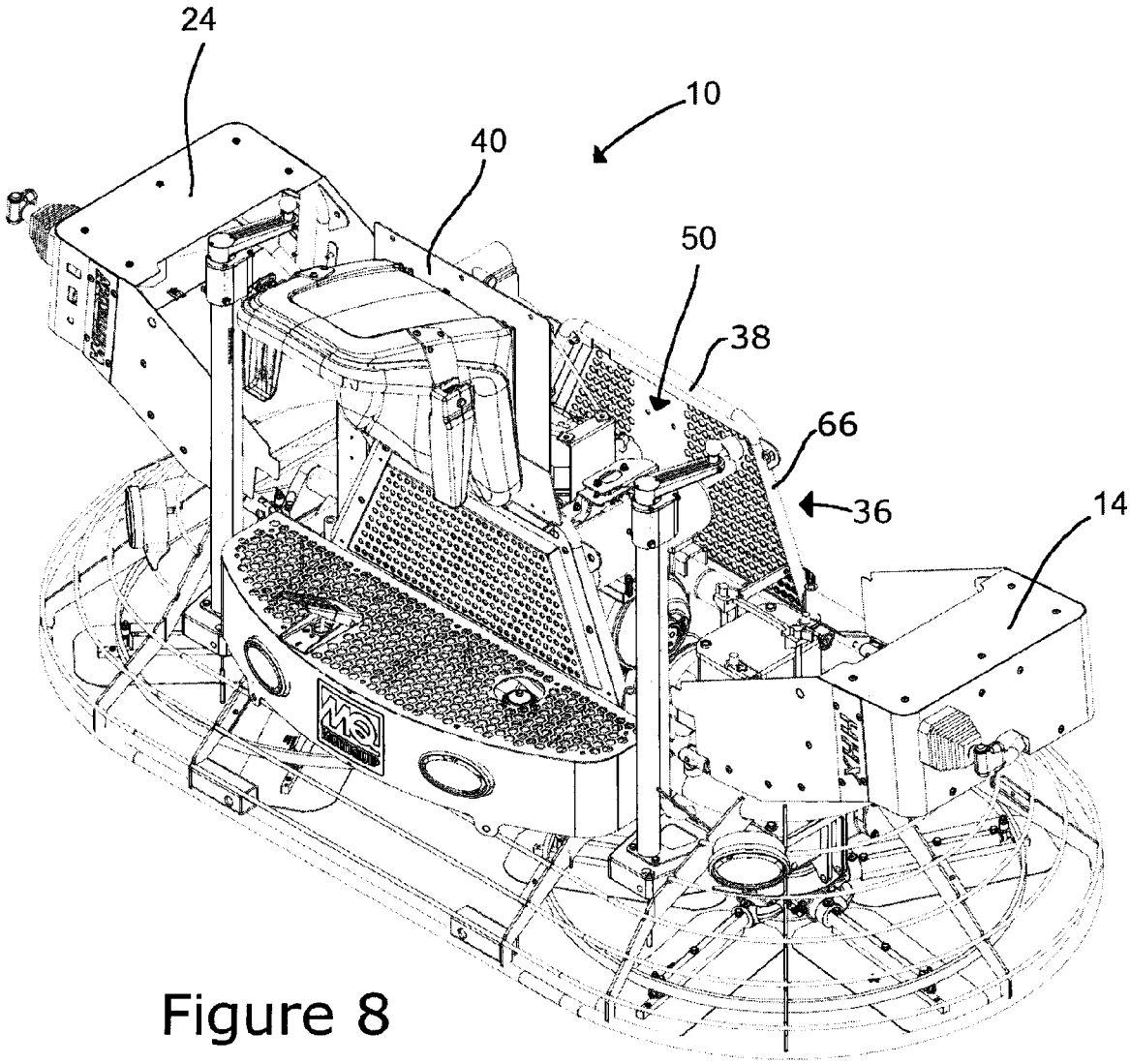
FIG. 8 is an isometric view of the front, top, and right of an unfolding ride-on power trowel in an open configuration according to a first embodiment.
Figure 9:
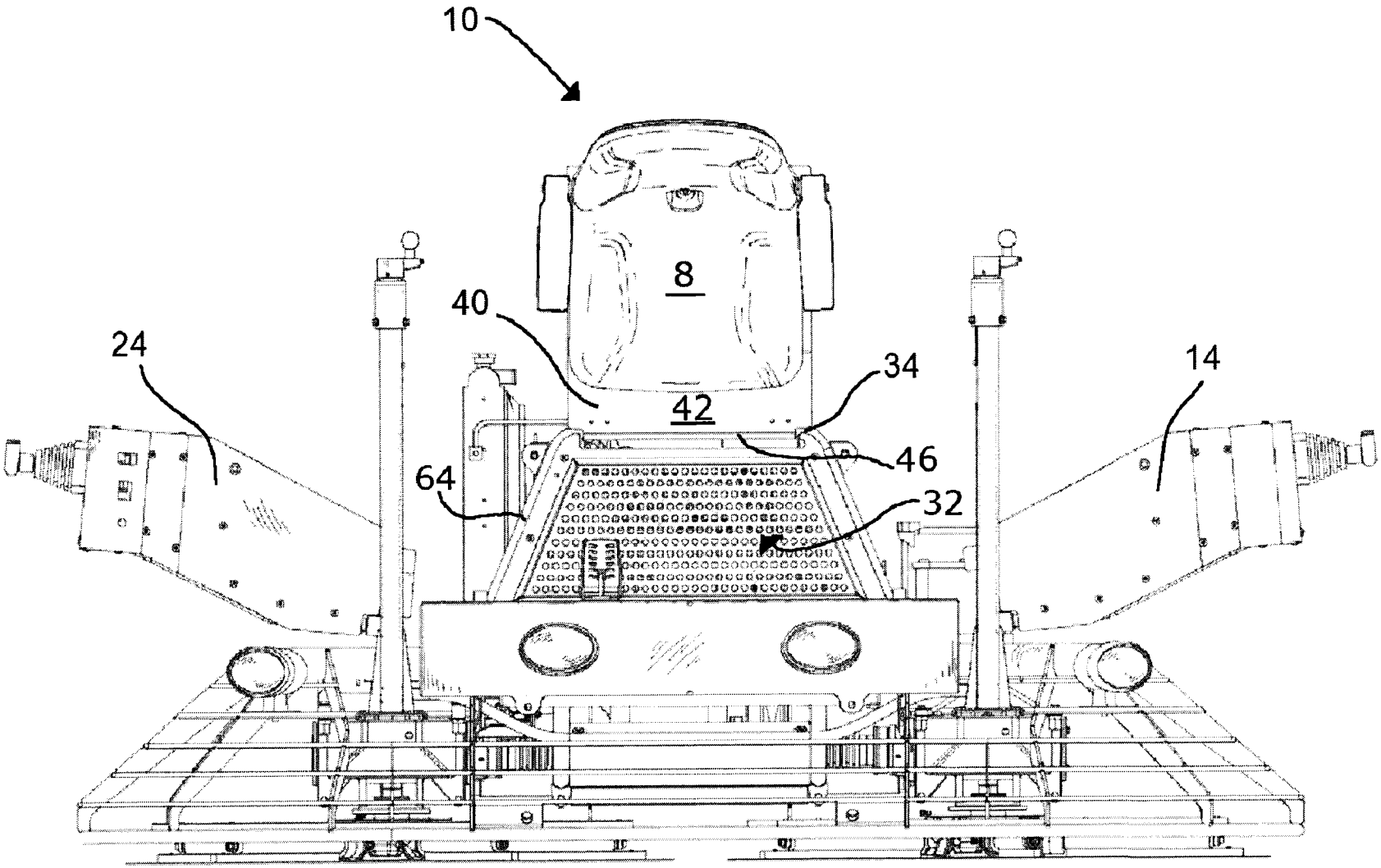
FIG. 9 is a front elevation view of an unfolding ride-on power trowel in an open configuration according to a first embodiment.
Figure 10:
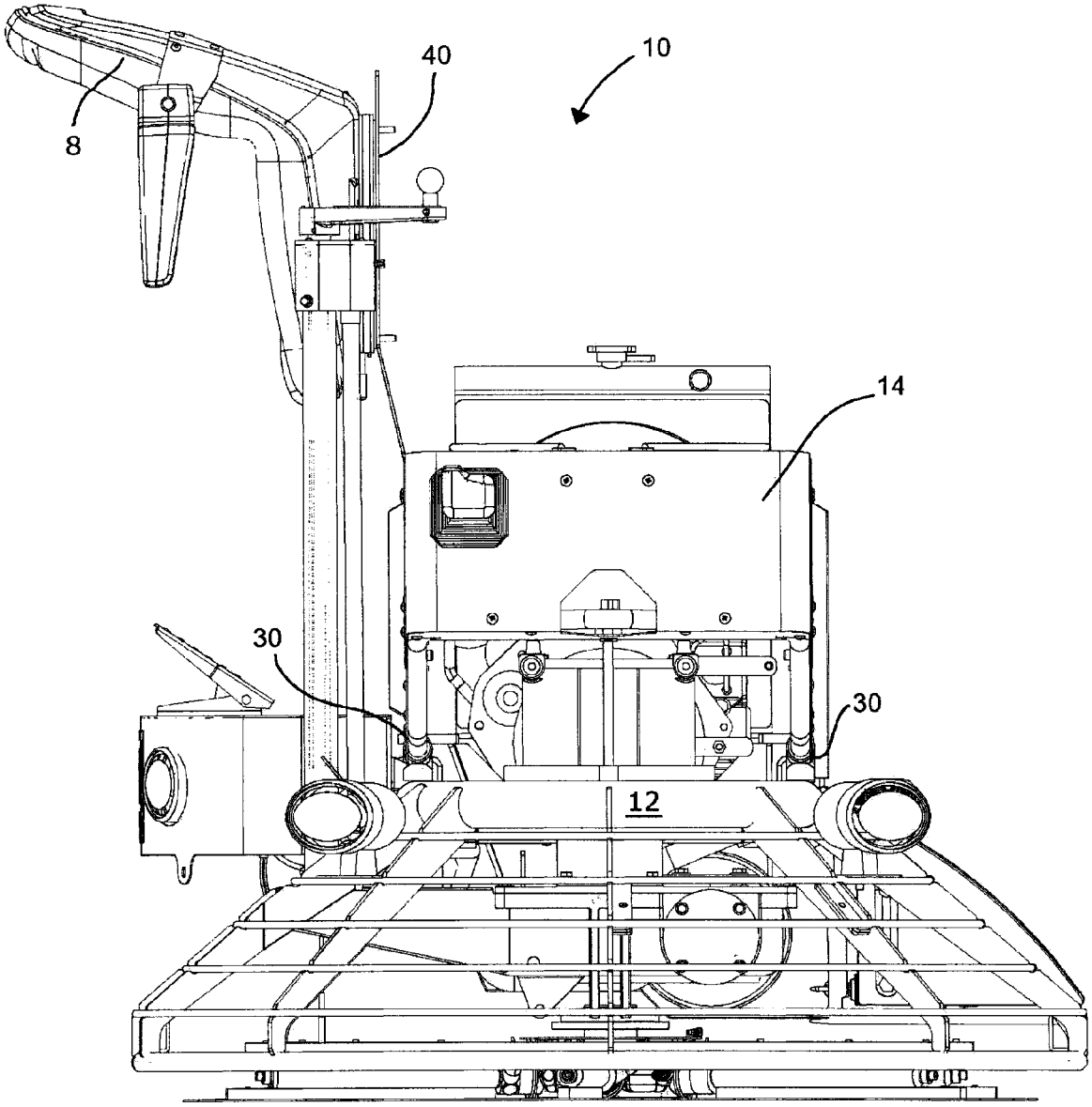
FIG. 10 is a right side elevation view of an unfolding ride-on power trowel in an open configuration according to a first embodiment.
Figure 11:
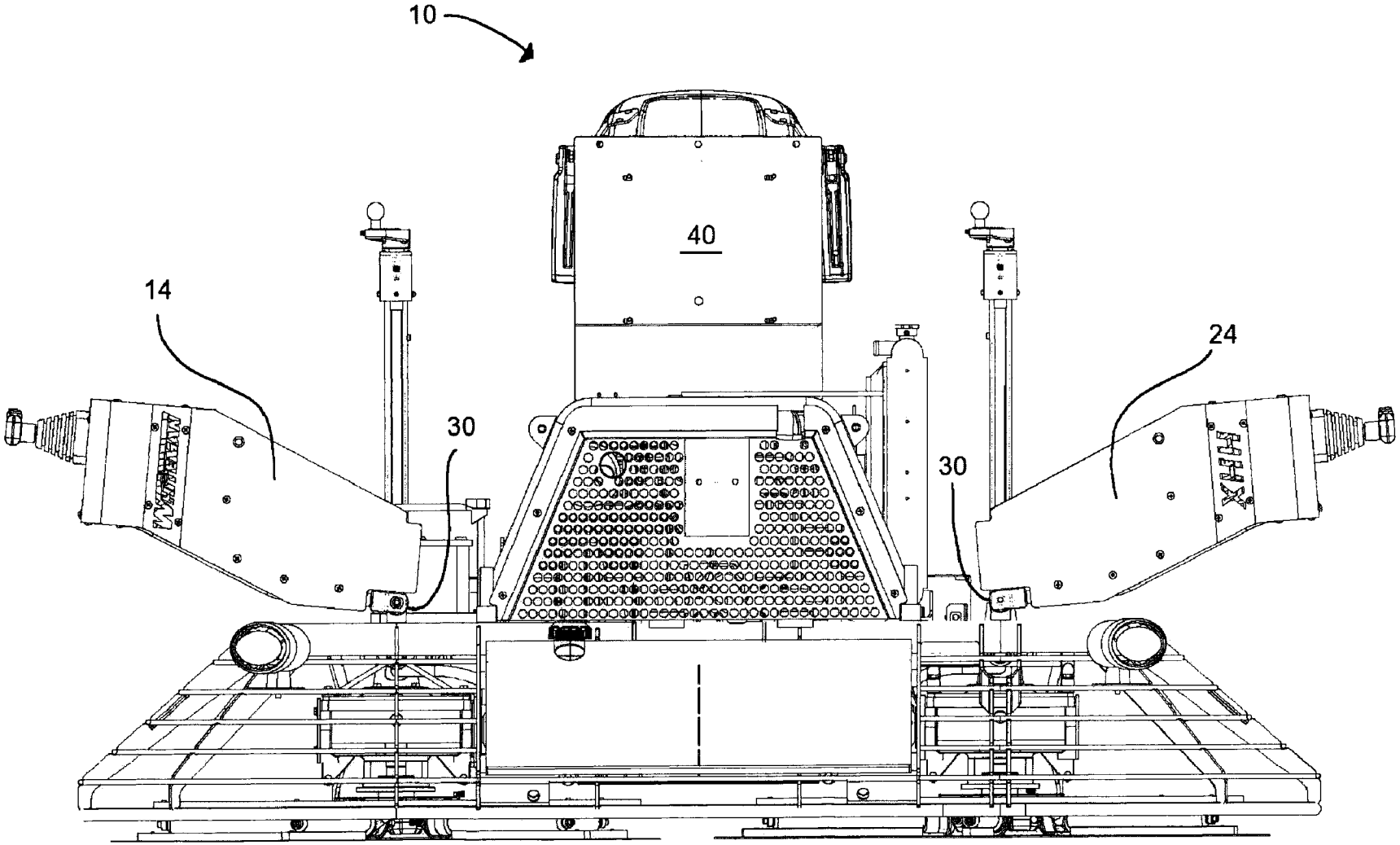
FIG. 11 is a back elevation view of an unfolding ride-on power trowel in an open configuration according to a first embodiment.

The left side cover 24 also includes pivot connections 28 (shown in FIG. 17) that are configured for connecting to pivots 30 attached to and supported by the frame 12, specifically a pair of left pivots 30 (FIG. 5). Through this interconnection, the left side cover 24 is pivotally connected to the frame 12 of the ride-on power trowel 10 via the pivots 30 (shown in FIGS. 5 and 13), about which the left side cover 24 may selectively pivot to move between the left closed configuration (FIG. 5) and the left open configuration (FIG. 13), and vice versa. Preferably, the left side cover 24 further includes a left handle 26 configured to be utilized by an operator in transitioning the left side cover 24 between the left closed configuration and the left open configuration and vice versa.

According to the preferred embodiment, a left side grating 20 (shown in FIG. 5 and identical to the side grating 20 shown in FIG. 16) is configured to be removably attached to the left side cover 24 and is preferably removed prior to the transition from the left side cover 24 from the left closed configuration to the left open configuration. Preferably, the side grating 20 is replaced after the left side cover 24 is transitioned from the left open configuration to the left closed configuration.

Further, the left side grating 20 is likewise configured to be removably attachable to the left side cover 24 via hardware such as a clip 52, washer 54, and screw 56. It should be noted that while FIG. 16 depicts the connection of the right side grating 20 to the right side cover 14, the depiction of the connection of the left side grating 20 to the left side cover 24 is identical. According to the depicted embodiment, therefore, only one connection need be disconnected to accommodate removal of the left side grating 20 from the left side cover 24. Thereafter, the left side cover 24 can be pivotally transitioned to the left open configuration, allowing access to the left-most of the internal workings 50 without having to further disassemble the unfolding ride-on power trowel 10. Preferably, this access to the left-most of the internal workings 50 is further accomplishable without having to transition the right side cover 14 to the right open configuration and without having to transition the seat platform 40 to the seat open configuration.

Figure 15:
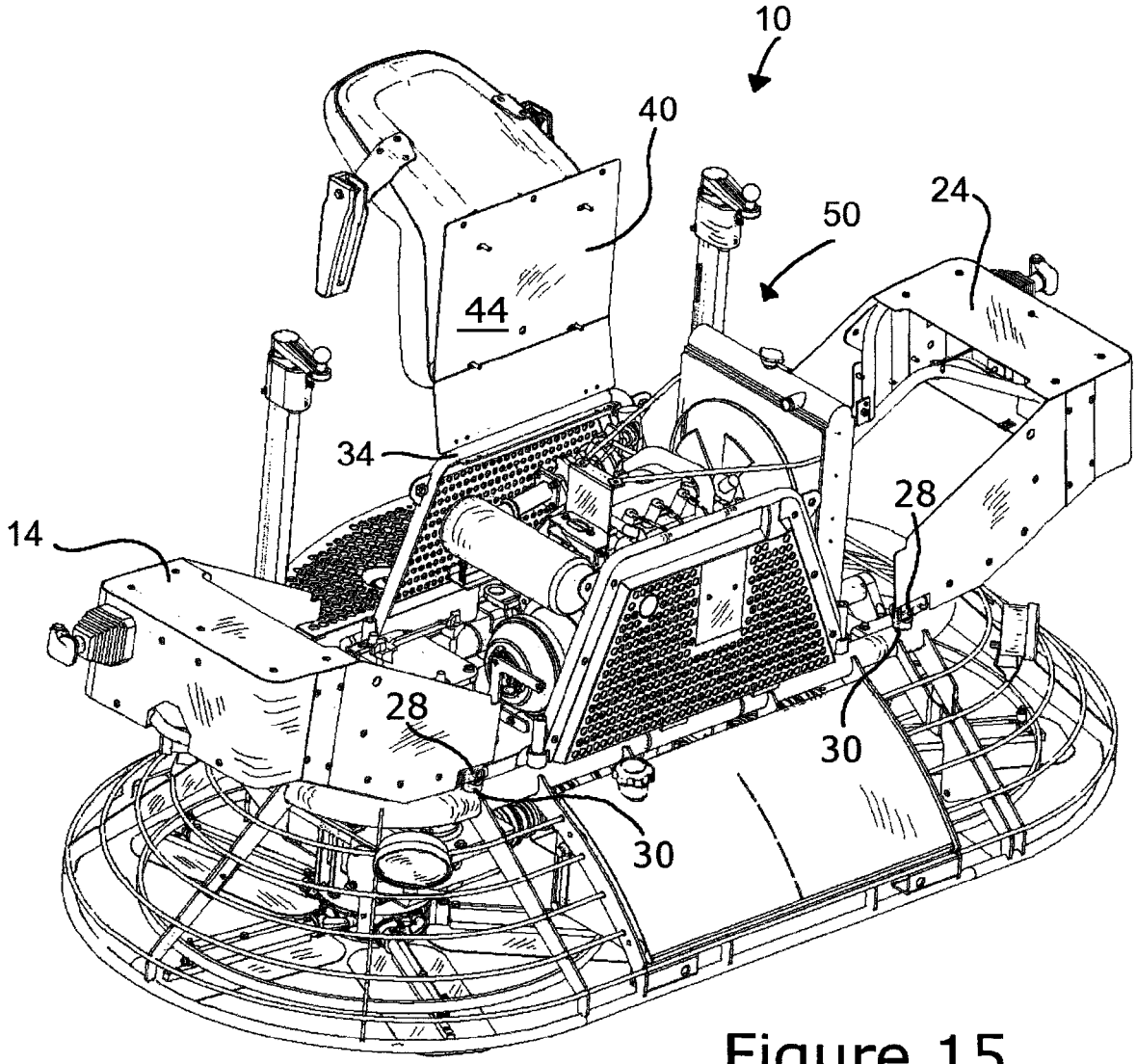
FIG. 15 is an isometric view of the back, top, and right side of an unfolding ride-on power trowel in an open configuration according to a first embodiment.
Figure 17:
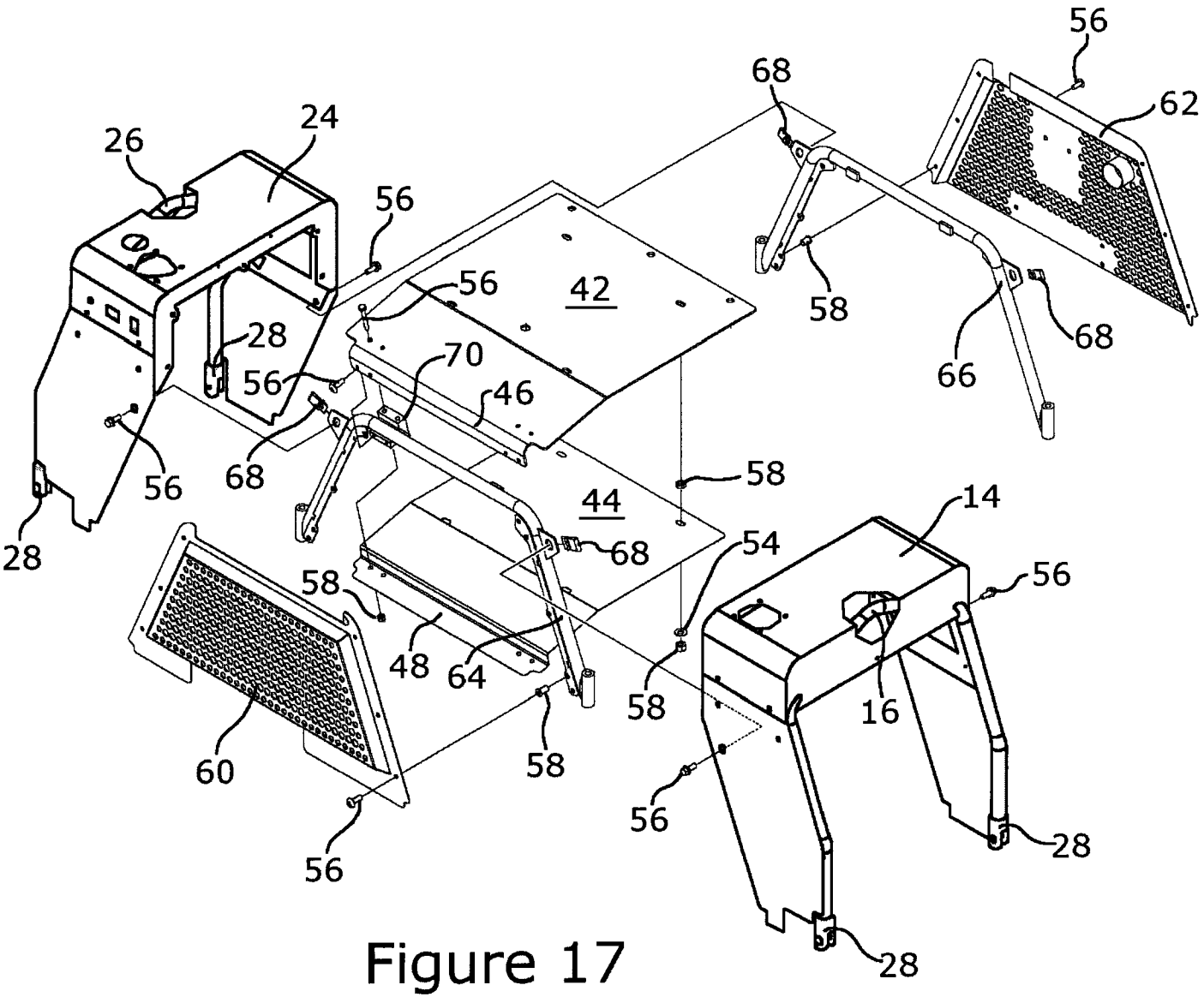
FIG. 17 is an exploded view of a right side cover, left side cover, front cover, back cover, and seat platform of an unfolding ride-on power trowel according to a first embodiment.

The seat platform 40 of the unfolding ride-on power trowel 10 is additionally pivotally connected. More specifically, in the depicted embodiment, it is pivotally connected to the front cover 32 via a pivot bar 34. That is, as shown in FIG. 17, the front cover 32 preferably includes a front subframe 64 that includes a pivot bar 34 and a front grating 60 that is attached to the front subframe 64 via hardware such as screws 56 and/or nuts 58. The seat platform 40 is configured to pivot about the pivot bar 34 in moving from the seat closed configuration (FIG. 7) to the seat open configuration (FIG. 15). More particularly, the seat platform 40 includes a top plate 42 and a bottom plate 44 where the top plate 42 has a front top plate edge 46 and the bottom plate 44 has a front bottom plate edge 48. The front top plate edge 46 is preferably configured to conform to an upper area of the pivot bar 34, as shown in FIG. 17. The front bottom plate edge 48 is preferably configured to conform to a lower area of the pivot bar 34, as shown in FIG. 17. Further, the front top plate edge 46 of the top plate 42 and the front bottom plate edge 48 of the bottom plate 44 are configured to be attached to one another such that the top plate 42 and the bottom plate 44 surround the pivot bar 34. Preferably, the front top plate edge 46 and the front bottom plate edge 48 are connected to one another via attachment to a block 70 supporting the connection of the seat platform 40 to the pivot bar 34 of the front subframe 64. According to the embodiment depicted in FIG. 17, the top plate 42 and bottom plate 44 are secured to the block 70 via hardware such as screws 56 and a nut 58. Preferably, a back area of both the top plate 42 and bottom plate 44 are secured to one another via additional hardware, such as a washer 54, a screw 56 and nuts 58.

While, according to the first embodiment, the seat platform 40 is pivotally connected to the front cover 32, in other embodiments, the seat platform 40 is pivotally connected to the back cover 36. The back cover 36, as shown in FIG. 17, includes a back subframe 66 that includes an upper back cover bar 38 and a back grating 62 that is attached to the back subframe 66 via hardware such as screws 56 and/or nuts 58. In embodiments in which the seat platform 40 is pivotally connected to the back cover 36, the top plate 42 of the seat platform 40 preferably includes a back top plate edge, shaped as the front top plate edge 46 depicted in FIG. 17, and configured to conform to an upper area of the upper back cover bar 38. Likewise, the bottom plate 44 of the seat platform 40 preferably includes a back bottom plate edge, shaped as the bottom top plate edge 48 depicted in FIG. 17, and configured to conform to a lower area of the upper back cover bar 38. Further, the back top plate edge and the back bottom plate edge are configured to be attached to one another such that the top plate 42 and the bottom plate 44 surround the upper back cover bar 38. Preferably, the back top plate edge 46 and the back bottom plate edge are connected to one another via attachment to a block 70 supporting the connection of the seat platform 40 to the upper back cover bar 38 of the back subframe 66. As with the connection depicted in FIG. 17, the top plate 42 and bottom plate 44 are secured to the block 70 via hardware such as screws 56 and a nut 58. Also, preferably, a front area of both the top plate 42 and bottom plate 44 are secured to one another via additional hardware, such as a washer 54, a screw 56, and nuts 58. It is to be noted that while FIG. 17 depicts the connection of the seat platform 40 to the pivot bar 34 of the front cover 32, the view would be identical if depicting the connection of the seat platform 40 to the upper back cover bar 38.

Also, in some embodiments, such as that shown in FIG. 17, when the right side cover 14 is in the closed configuration, the right side cover 14 is removably connected to the front subframe 64 and back subframe 66 via hardware such as screws 56 and retainer nuts 68, with one such removable connection preferably being made on both the front and back sides of the right side cover 14.

Likewise, in embodiments such as that shown in FIG. 17, when the left side cover 24 is in the closed configuration, the left side cover 24 is preferably removably connected to the front subframe 64 and back subframe 66 via hardware such as screws 56 and retainer nuts 68, with one such removable connection preferably being made on both the front and back sides of the left side cover 24.

Notably, when the right side cover 14 is in the right closed configuration, the left side cover 24 is in the left closed configuration, and the seat platform 40 is in the seat closed configuration (FIGS. 1 through 7), the right side cover 14 abuts the seat platform 40, the front cover 32, and the back cover 36; the left side cover 24 abuts the seat platform 40, the front cover 32, and the back cover 36; and the seat platform 40 abuts the front cover 32, the back cover 36, the right side cover 14, and the left side cover 24.

While, according to the first preferred embodiment, the open configuration of the unfolding ride-on power trowel 10 includes the right side cover 14 being in the right open configuration, the left side cover 24 being in the left open configuration, and the seat platform 40 being in the seat open configuration, in other embodiments, the unfolding ride-on power trowel 10 is configured to accommodate transitioning the right side cover 14 to the right open configuration while the left side cover 24 remains in the left closed configuration and the seat platform 40 remains in the seat closed configuration. This allows ready access to the right-most of the internal workings 50.

Similarly, in some embodiments, the unfolding ride-on power trowel 10 is configured to accommodate transitioning the left side cover 24 to the left open configuration while the right side cover 14 remains in the right closed configuration and the seat platform 40 remains in the seat closed configuration. This allows ready access to the left-most of the internal workings 50.

Still further, in some embodiments, the unfolding ride-on power trowel 10 is configured to accommodate transitioning the seat platform 40 to the seat open configuration while the right side cover 14 remains in the right closed configuration and the left side cover 24 remains in the left closed configuration. This allows ready access to the upper-most of the internal workings 50.

While there is shown and described the present preferred embodiment of the unfolding ride-on power trowel, it is to be distinctly understood that this ride-on trowel is not limited thereto but may be variously embodied to practice within the scope of this disclosure. From the foregoing description, it will be apparent that various changes may be made without departing from the spirit and scope of the invention as defined by this disclosure.

Still other features and advantages of the present invention will become readily apparent to those skilled in this art from the forgoing detailed description describing preferred embodiments of the invention, simply by way of illustration of the best mode contemplated by carrying out the invention. As will be realized, the unfolding ride-on power trowel is capable of modification in various obvious respects all without departing from the invention. For example, in some embodiments, each of the side gratings 20 are pivotally connected to the corresponding right side cover 14 or left side cover 24, such that before transitioning the right side cover 14 between the right closed configuration and the right open configuration, the right-most side grating 20 is pivotally extended away from the frame 12 so that the right side cover 14 and the right-most side grating 20 lay in an almost 180-degree relation to one another when said right side cover 14 is in the right open configuration. Similarly, in such an embodiment, the left-most side grating 20 is pivotally connected to the left side cover 24, such that, before transitioning the left side cover 24 between the left closed configuration and the left open configuration, the left-most side grating 20 is pivotally extended away from the frame 12 so that the left side cover 24 and the left-most side grating 20 lay in an almost 180-degree relation to one another when said left side cover 24 is in the left open configuration. In such an embodiment, no part of the unfolding ride-on power trowel 10 need be disconnected completely from the power trowel 10 in order to gain ready access to the internal workings 50 of the machine 10.

Because the unfolding ride-on power trowel may be modified in various obvious ways while still being within the scope of the invention, the drawings and description of the preferred embodiments are to be regarded as illustrative in nature, and not as restrictive in nature.

The invention claimed is:

1. An unfolding ride-on machine comprising:

a frame;

a front cover supported by said frame;

a back cover supported by said frame;

internal workings supported by said frame and contained within an internal space;

a right side cover pivotally connected to said frame, said right side cover being configured to be selectively pivoted between a right open configuration and a right closed configuration, said right side cover being further configured to at least partially cover said internal space when positioned in said right closed configuration;

a left side cover pivotally connected to said frame, said left side cover being configured to be selectively pivoted between a left open configuration and a left closed configuration, said left side cover being further configured to at least partially cover said internal space when positioned in said left closed configuration;

a seat platform pivotally connected to said front cover and configured to be selectively pivoted between a seat open configuration and a seat closed configuration, said seat platform being further configured to at least partially cover said internal space when positioned in said seat closed configuration;

wherein, when said right side cover is positioned in said right closed configuration, said left side cover is positioned in said left closed configuration, and said seat platform is positioned in said seat closed configuration, access to said internal works is substantially blocked; and wherein, when said right side cover is positioned in said right open configuration, said left side cover is positioned in said left open configuration, and said seat platform is positioned in said seat open configuration, access to said internal works is substantially available.

2. The unfolding ride-on machine of claim 1, further comprising:

a plurality of pivots attached to said frame;

said front cover including a front subframe having a pivot bar;

said right side cover including right pivot connections configured to be attached to at least one of said pivots;

said left side cover including left pivot connections configured to be attached to at least one of said pivots;

said right side cover being pivotally connected to said frame via connection of said right pivot connections with at least one of said pivots, said right side cover being configured to pivot between said right closed configuration and said right open configuration about said right pivots;

said left side cover being pivotally connected to said frame via connection of said left pivot connections with at least one of said pivots, said left side cover being configured to pivot between said left closed configuration and said left open configuration about said left pivots; and said seat platform being pivotally connected to said front cover via connection of said seat platform to said pivot bar, said seat platform being configured to pivot between said seat closed configuration and said seat open configuration about said pivot bar.

3. The unfolding ride-on machine of claim 2, wherein said seat platform comprises:

a top plate;

a bottom plate attached to said top plate such that said top plate and said bottom plate surround said pivot bar.

4. The unfolding ride-on machine of claim 2, wherein said seat platform comprises:

a top plate having a front top plate edge configured to conform to an upper area of said pivot bar;

a bottom plate having a front bottom plate edge configured to conform to a lower area of said pivot bar;

said front top plate edge and said front bottom plate edge being configured to be attached to one another such that said top plate and said bottom plate surround said pivot bar.

5. The unfolding ride-on machine of claim 1, wherein, when said right side cover is in said right closed configuration, and when said left side cover is in said left closed configuration, and when said seat platform is in said seat closed configuration, said right side cover abuts said seat platform, said front cover, and said back cover;

said left side cover abuts said seat platform, said front cover, and said back cover; and said seat platform abuts said right side cover, said left side cover, said front cover, and said back cover.

6. The unfolding ride-on machine of claim 1, wherein said right side cover, said left side cover, said seat platform, said front cover, and said back cover define said internal space when said right side cover is in said right closed configuration, said left side cover is in said left closed configuration, and said seat platform is in said seat closed configuration.

7. The unfolding ride-on machine of claim 1, further comprising:

a right side grating removably attachable to said right side cover; and a left side grating removably attachable to said left side cover.

8. The unfolding ride-on machine of claim 1, wherein said right side cover further includes a right handle; and said left side cover further includes a left handle.

9. An unfolding ride-on machine comprising:

a frame;

a front cover supported by said frame;

a back cover supported by said frame;

internal workings supported by said frame and contained within an internal space;

a right side cover pivotally connected to said frame, said right side cover being configured to be selectively pivoted between a right open configuration and a right closed configuration, said right side cover being further configured to at least partially cover said internal space when positioned in said right closed configuration;

a left side cover pivotally connected to said frame, said left side cover being configured to be selectively pivoted between a left open configuration and a left closed configuration, said left side cover being further configured to at least partially cover said internal space when positioned in said left closed configuration;

a seat platform pivotally connected to said back cover and configured to be selectively pivoted between a seat open configuration and a seat closed configuration, said seat platform being further configured to at least partially cover said internal space when positioned in said seat closed configuration;

wherein, when said right side cover is positioned in said right closed configuration, said left side cover is positioned in said left closed configuration, and said seat platform is positioned in said seat closed configuration, access to said internal works is substantially blocked; and wherein, when said right side cover is positioned in said right open configuration, said left side cover is positioned in said left open configuration, and said seat platform is positioned in said seat open configuration, access to said internal works is substantially available;

a plurality of pivots attached to said frame;

said back cover including a back subframe having an upper back cover bar;

said right side cover including right pivot connections configured to be attached to at least one of said pivots;

said left side cover including left pivot connections configured to be attached to at least one of said pivots;

said right side cover being pivotally connected to said frame via connection of said right pivot connections with at least one of said pivots, said right side cover being configured to pivot between said right closed configuration and said right open configuration about said right pivots;

said left side cover being pivotally connected to said frame via connection of said left pivot connections with at least one of said pivots, said left side cover being configured to pivot between said left closed configuration and said left open configuration about said left pivots; and said seat platform being pivotally connected to said back cover via connection of said seat platform to said upper back cover bar, said seat platform being configured to pivot between said seat closed configuration and said seat open configuration about said upper back cover bar.

10. The unfolding ride-on machine of claim 9, wherein said seat platform comprises:

a top plate;

a bottom plate attached to said top plate such that said top plate and said bottom plate surround said upper back cover bar.

11. The unfolding ride-on machine of claim 9, wherein said seat platform comprises:

a top plate having a back top plate edge configured to conform to an upper area of said upper back cover bar;

a bottom plate having a back bottom plate edge configured to conform to a lower area of said upper back cover bar;

said back top plate edge and said back bottom plate edge being configured to be attached to one another such that said top plate and said bottom plate surround said upper back cover bar.

12. An unfolding ride-on machine comprising:

a frame;

a pair of right pivots fixedly attached to said frame;

a pair of left pivots fixedly attached to said frame;

a front cover supported by said frame, said front cover including a front subframe supported by said frame, said front subframe including a pivot bar; and a front grating attached to said front subframe;

a back cover supported by said frame, said back cover including a back subframe supported by said frame, said back subframe including an upper back cover bar; and a back grating attached to said back subframe;

internal workings supported by said frame and contained within an internal space;

a right side cover including a pair of right pivot connections attached to said pair of right pivots, said right side cover being configured to be selectively pivoted about said right pivots between a right open configuration and a right closed configuration, said right side cover being further configured to at least partially cover said internal space when positioned in said right closed configuration;

a left side cover including a pair of left pivot connections attached to said pair of left pivots, said left side cover being configured to be selectively pivoted about said left pivots between a left open configuration and a left closed configuration, said left side cover being further configured to at least partially cover said internal space when positioned in said left closed configuration;

a seat platform pivotally connected to said pivot bar of said front cover and configured to be selectively pivoted about said pivot bar between a seat open configuration and a seat closed configuration, said seat platform being further configured to at least partially cover said internal space when positioned in said seat closed configuration;

wherein, when said right side cover is positioned in said right closed configuration, said left side cover is positioned in said left closed configuration, and said seat platform is positioned in said seat closed configuration, access to said internal works is substantially blocked; and wherein, when said right side cover is positioned in said right open configuration, said left side cover is positioned in said left open configuration, and said seat platform is positioned in said seat open configuration, access to said internal works is substantially available.

13. The unfolding ride-on machine of claim 12, further comprising:

a right side grating removably attachable to said right side cover; and a left side grating removably attachable to said left side cover.

* * * * *